US006339368B1

(12) United States Patent
Leith

(10) Patent No.: US 6,339,368 B1
(45) Date of Patent: Jan. 15, 2002

(54) CIRCUIT FOR AUTOMATICALLY DRIVING MECHANICAL DEVICE AT ITS RESONANCE FREQUENCY

(75) Inventor: James W. Leith, Seattle, WA (US)

(73) Assignee: Zilog, Inc., Campbell, CA (US)

( * ) Notice: Subject to any disclaimer, the term of this patent is extended or adjusted under 35 U.S.C. 154(b) by 0 days.

(21) Appl. No.: 09/539,764

(22) Filed: Mar. 31, 2000

(51) Int. Cl.[7] ..... G08B 3/10

(52) U.S. Cl. ..... 340/384.4; 340/384.6; 340/384.73; 381/97; 381/114

(58) Field of Search ..... 340/384.4, 384.6, 340/384.73, 384.1; 381/97, 114, 150; 331/4

(56) References Cited

U.S. PATENT DOCUMENTS

| | | | | | |
|---|---|---|---|---|---|
| 3,743,868 | A | * | 7/1973 | Kawada | 310/8.1 |
| 3,931,533 | A | | 1/1976 | Raso et al. | 310/8.1 |
| 4,275,363 | A | | 6/1981 | Mishiro et al. | 331/4 |
| 4,275,388 | A | | 6/1981 | Hornung | 340/384 |
| 4,509,372 | A | | 4/1985 | Mount | 73/861.28 |
| 4,587,958 | A | | 5/1986 | Noguchi et al. | 310/316 X |
| 4,724,401 | A | | 2/1988 | Hogge, Jr. et al. | 331/4 |
| 4,754,186 | A | | 6/1988 | Choperena et al. | 310/316 |
| 4,965,532 | A | | 10/1990 | Sakurai | 331/4 |
| 5,180,363 | A | * | 1/1993 | Idemoto et al. | 202/32 |
| 5,181,019 | A | * | 1/1993 | Gottlieb et al. | 340/474 |
| 5,508,579 | A | * | 4/1996 | Suganuma | 310/316 |
| 5,596,311 | A | | 1/1997 | Bess et al. | 340/384.7 |
| 6,157,271 | A | * | 11/1998 | Black et al. | 332/127 |
| 5,897,569 | A | | 4/1999 | Kellogg et al. | 606/169 |

* cited by examiner

*Primary Examiner*—Daniel J. Wu
*Assistant Examiner*—Phung T Nguyen
(74) *Attorney, Agent, or Firm*—Skjerven Morrill & MacPherson LLP

(57) ABSTRACT

A circuit for automatically driving a mechanical device at its resonance frequency is provided. To do so, the circuit detects non-resonance driving conditions of the mechanical device being coupled to and driven by such circuit. Based on such detection, the circuit generates a signal to drive the device at its resonance frequency.

29 Claims, 5 Drawing Sheets

CIRCUIT FOR AUTOMATICALLY DRIVING MECHANICAL DEVICE AT ITS RESONANCE FREQUENCY

FIELD OF THE INVENTION

The present invention relates to a circuit for driving a mechanical device at its resonance frequency. More particularly, the present invention relates to a circuit for automatically driving a device at its resonance frequency.

BACKGROUND OF THE INVENTION

Various types of audible indicators that employ a piezoelectric or electro-mechanical transducer to generate a relatively piercing and noticeable audible tone when energized with power have been used for many applications. Such indicators are commonly used in numerous small and large appliances and alarm systems, and for other applications in which the generation of an audible signal is required. For example, for safety reasons, many heavy duty machineries such as forklifts and bulldozers include a backup alarm system that will generate a loud, and sometimes offensive, warning signal during their operation in the reverse driving mode so as to warn passersby of their movement.

During their operation, these alarm systems are preferably operated at or near the resonance frequency of the vibrating element even though such alarm systems may be operated at other frequencies. By operating at or near the resonance frequency, the most efficient use of available electrical energy to produce the greatest audible output is achieved. As a result, manufacturers often will test their alarm systems and, if necessary, adjust or tweak such alarm systems to produce the maximum audible output. Although this manufacturing step is implemented as a quality control step to ensure that each alarm system leaving the factory will operate at its maximum efficiency, the resonance frequency of each alarm system may later vary due to such factors as aging, and varying temperature and humidity. In light of such previously-stated problem, various alarm systems have been proposed so as to operate at or near a resonance frequency at any time during their usage. These proposed alarm systems are generally complicated and costly.

Accordingly, it is desirable to eliminate the above-mentioned labor-intensive manufacturing step of testing each alarm system to ensure that each alarm system leaving the factory will operate at its maximum efficiency, especially when the resonance frequency later may vary due to uncontrollable factors. By reducing such step in their manufacturing process, makers of alarm systems can effectively reduce the costs associated with the production of these alarm systems. In addition, it is also desirable to provide a simplified circuit capable of automatically driving the vibrating element of these alarm systems at or substantially near a resonance frequency so that minimal electrical energy is used to produce the greatest audible output.

The above-mentioned labor-intensive testing step is further associated with the production of [1] wireless RF "key fobs" for car security alarm systems and [2] remote control garage door openers. In order to transmit signals, the wireless RF key fobs and remote control garage door openers include a signal transmitting device such as an antenna. Although very little power is required to drive the antenna, it is still desirable to extend the life of the battery providing such power. Thus, prior to their shipment from the manufacturers to the wholesalers or retailers these wireless RF key fobs and remote control garage door openers are also tweeked or adjusted for maximum power efficiency. Similar to the alarm systems, maximum power efficiency of the wireless RF key fobs and remote control garage door openers is achieved when the antenna is driven at a resonance frequency.

Accordingly, it is also desirable to eliminate the above-mentioned labor-intensive manufacturing step of testing each wireless RF key fob or remote control garage door opener by providing a circuit capable of automatically driving the antenna at or substantially near a resonance frequency so that minimal electrical energy is used to transmit signals.

SUMMARY OF THE INVENTION

Generally, the present invention is directed to a circuit for automatically driving a mechanical device at its resonance frequency. To do so, the circuit detects non-resonance driving conditions of the mechanical device being coupled to and driven by such circuit. Based on such detection, the circuit generates a signal to drive the device at its resonance frequency.

More specifically, according to one aspect of the present invention, an acoustic transducer system is provided. The acoustic transducer system comprises [1] a power supply, [2] an acoustic transducer having a first electrical terminal coupled to the power supply and a second electrical terminal coupled to a reference ground, and [3] a phase-locked loop circuit detecting a phase difference between first and second signals at the first and second electrical terminals, respectively, and generating an output signal based on the detected phase difference to drive the acoustic transducer via a feedback connection forming a closed loop from the phase-locked loop circuit back to the second electrical terminal. The output signal generated by phase-locked loop circuit drives the acoustic transducer at a resonance frequency when the detected phase difference is negligible.

According to another aspect of the invention, a circuit automatically drives an antenna coupled to the circuit at a resonance frequency when a power supply is provided. This circuit comprises [1] a major feedback circuit providing an output signal, [2] a power amplifier driving the antenna in response to the output signal of the major feedback circuit, wherein the major feedback circuit detects a frequency difference between its output signal and a reference signal being provided to the major feedback circuit, and [3] a minor feedback circuit, coupled to the antenna and the major feedback circuit, detecting a phase difference between voltage and current signals provided by the power amplifier to drive the antenna, wherein the major feedback circuit generates the output signal based on the detected frequency and phase differences, and further wherein the power amplifier drives the antenna at the resonance frequency when the detected phase difference is negligible.

These and other features and advantages of the present invention will be apparent from the drawings as fully explained in the Detailed Description of the Preferred Embodiments.

BRIEF DESCRIPTION OF THE DRAWINGS

Other objects and features of the present invention and many of the attendant advantages of the present invention will be readily appreciated and become better understood by reference to the detailed description when considered in connection with the accompany drawings in which like reference numerals designate like parts throughout the figures thereof and wherein.

DETAILED DESCRIPTION OF THE PREFERRED EMBODIMENTS

Figure 1:
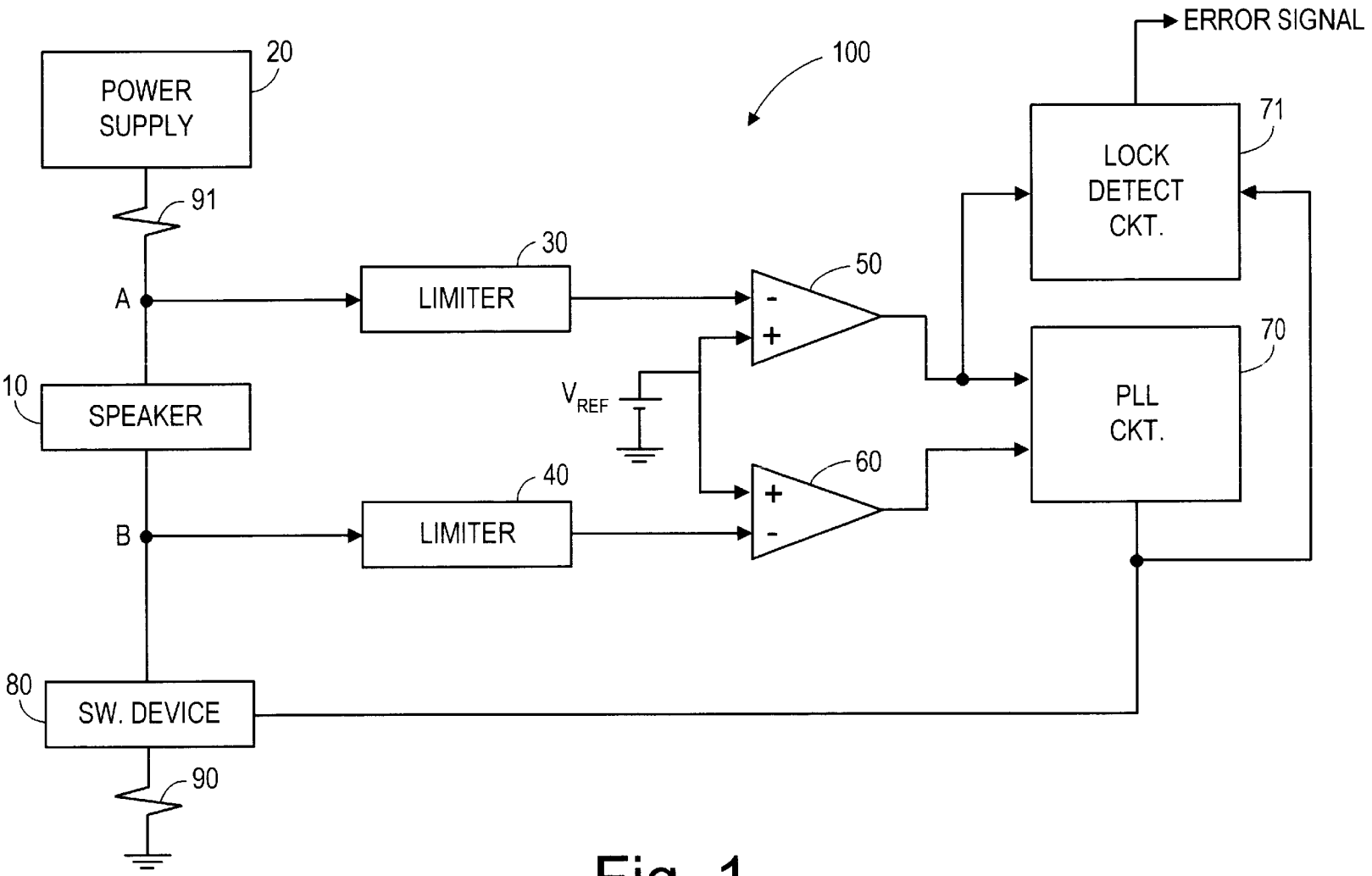
FIG. 1 illustrates a first embodiment of the present invention that is capable of automatically driving an acoustic device such as the illustrated speaker at a resonance frequency.

FIG. 1 illustrates the first embodiment of the present invention. This first embodiment includes a circuit 100 that is capable of automatically driving an acoustic transducer, such as a speaker 10 or a piezoelectric device, coupled to the circuit 100, at a resonance frequency when a power supply 20 is provided. Preferably the power supply 10 is a battery. For example, if the speaker 10 is a part of an alarm system installed on a bulldozer, the power supply 20 would be the battery of such bulldozer.

The circuit 100 of FIG. 1 includes first and second zero-crossing limiters 30, 40, voltage comparators 50, 60, a phase-locked loop circuit 70, a switching device 80 and resistive elements 90, 91. With respect to their electrical connections, the speaker 10 is coupled to the circuit 100 via its connection to and between nodes A, B to which the first and second limiters 30, 40 are also respectively coupled. The comparator 50 is coupled to and between the limiter 30 and the phase-locked loop circuit 70. Similarly, the comparator 60 is coupled to and between the limiter 40 and the phase-locked loop circuit 70. The phase-locked loop circuit 70 is coupled to the switching device 80 which is in turn coupled to node B so as to effectively provide a feedback connection forming a closed loop. The resistive element 90 is coupled to and between the switching device 80 and a reference ground to minimize the dissipation of electrical energy. And lastly, the resistive element 91 is coupled to and between the power supply 20 and node A to provide isolation from the power supply 20 and thus allow the limiter 30 to sense the signal at node A.

When the power supply 20 provides electrical energy to drive the speaker 10, the limiters 30 and 40 detect signals at nodes A, B, respectively, and convert the detected signals at nodes A, B into first and second signals having a common zero-crossing reference so that the circuit 100 can accurately detect a phase difference between the signals at nodes A, B. Thereafter, the comparators 50, 60 respectively convert the first and second signals into digital signals. These digital signals are then provided to the phase-locked loop circuit 70 which detects their phase difference. Based on the detected phase difference, the phase-locked loop circuit provides an output signal to the drive the speaker 70 via the switching device 80.

It should be noted that the signals at nodes A, B being detected to determine their phase difference are voltage signals at such nodes. Alternatively, voltage and current signals at nodes A, B, respectively, may also be detected to determine their phase difference. This phase difference is also equivalent to the phase difference between the detected voltage signals due to Ohm's Law. More specifically, $V_B=V_A-IZ$, where $V_B$ is the voltage at node B, $V_A$ is the voltage at node A, I is the current flowing from node A to node B, and Z is the complex impedance of the speaker 10.

Furthermore, in a preferred embodiment, the circuit 100 also includes a lock detect circuit 71 providing an error signal that indicates whether the speaker 10 is being driven at its resonance frequency by the circuit 100. This error signal may be used to drive a light emitting diode (LED) so as to cause the LED to turn [1] "off" when the speaker 10 is being driven at its resonance frequency and [2] "on" when the speaker 10 is not being driven at its resonance frequency, or vice versa. Thus, if the LED remains "on" for a while, this may indicate that [1] there is a fault associated with the speaker 10 so as to cause an open circuited condition between nodes A, B or [2] the switching device 80 is not working properly. If such indication is desirable, the lock detect circuit 71 is coupled to the phase locked loop circuit 70 so as to detect a phase difference between [1] one of the input signals of the phase locked loop circuit 70 and [2] the output signal of the phase locked loop circuit 70 being provided to drive the speaker 10. The input signals of the phase locked loop circuit 70 may be the signals at nodes A, B or the output signals of the comparators 50, 60. When such detected phase difference is negligible, the LED would be "off" and when the detected phase difference is not negligible, the LED would be "on."

Figure 2:
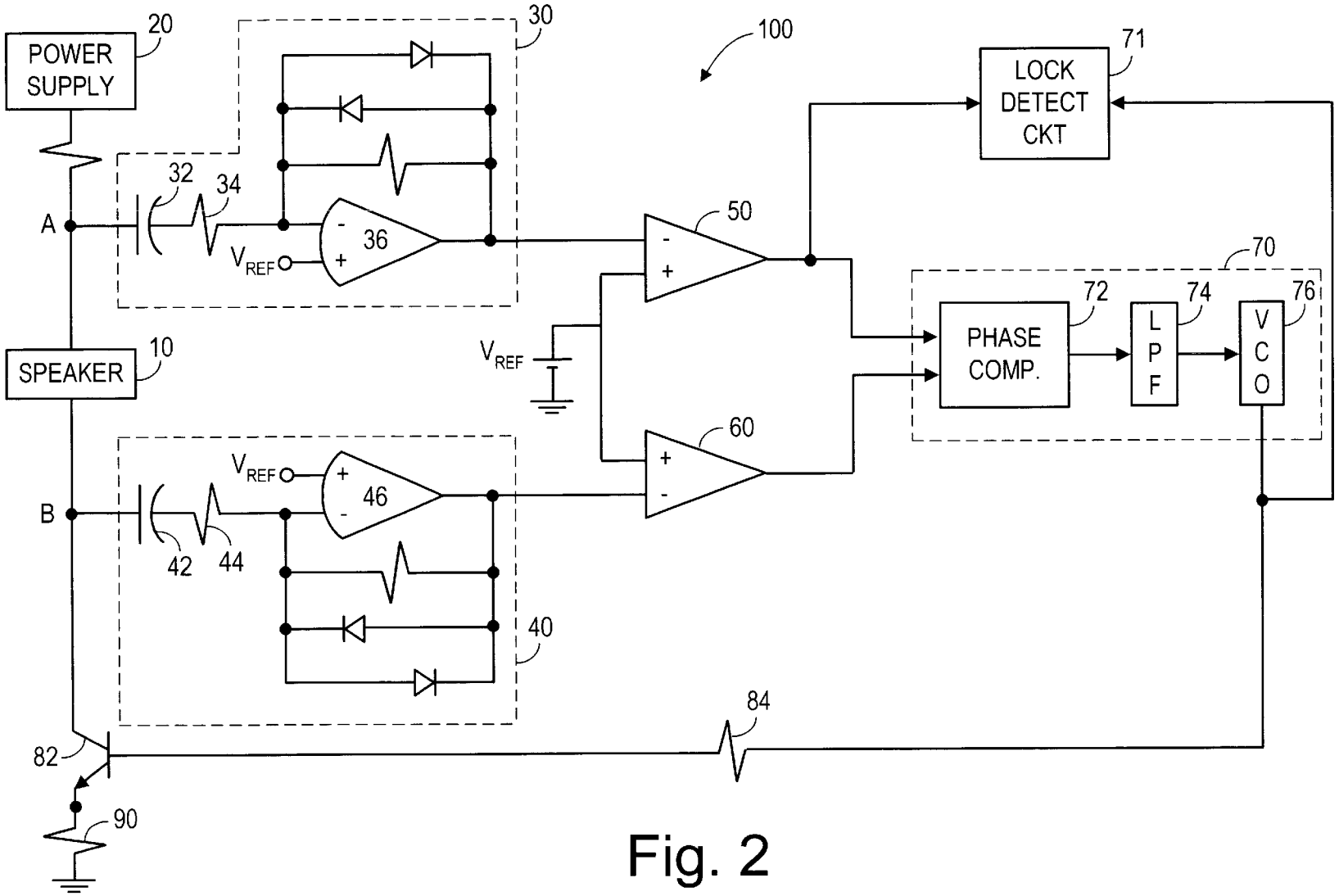
FIG. 2 illustrates the first embodiment of present invention in detail especially with respect to its first and second limiters.

The operation of the circuit 100 is now further explained in detail with respect to FIG. 2. More specifically, FIG. 2 illustrates preferred embodiments of the limiters 30, 40 and the phase-locked loop circuit 70 in detail. With respect to the limiters 30, 40, the signals at nodes A, B are coupled to them via their respective capacitive elements 32, 42. Thus, the circuit 100 only "sees" alternating current components of the signals at nodes A, B. Coupled to the capacitive elements 32,42 are resistive elements 34, 44, respectively. The resistive elements 34, 44 are also coupled to inverting terminals of amplifiers 36, 46, respectively. Preferably, the amplifiers 36, 46 are operational amplifiers. Each of the amplifiers 36, 46 also has a non-inverting terminal that is coupled to a reference voltage and an output terminal that is coupled to the respective comparator. In addition, each of the limiters 30, 40 further includes an additional resistive element and two diodes that are coupled to the respective amplifier in accordance with the electrical connection shown in FIG. 2.

When the signals at nodes A, B are detected by the limiters 30, 40, the limiters 30, 40 respectively convert the detected signals to first and second signals having the reference voltage as a common zero-crossing reference. In addition, minimum and maximum values of the first and second signals are substantially identical. More specifically, the minimum value of the first and second signals is the reference voltage minus the voltage drop across one of the diodes which is typically around 0.7 volt. The maximum value of the first and second signals is the reference voltage plus the voltage drop across one of the diodes.

Figure 2A:
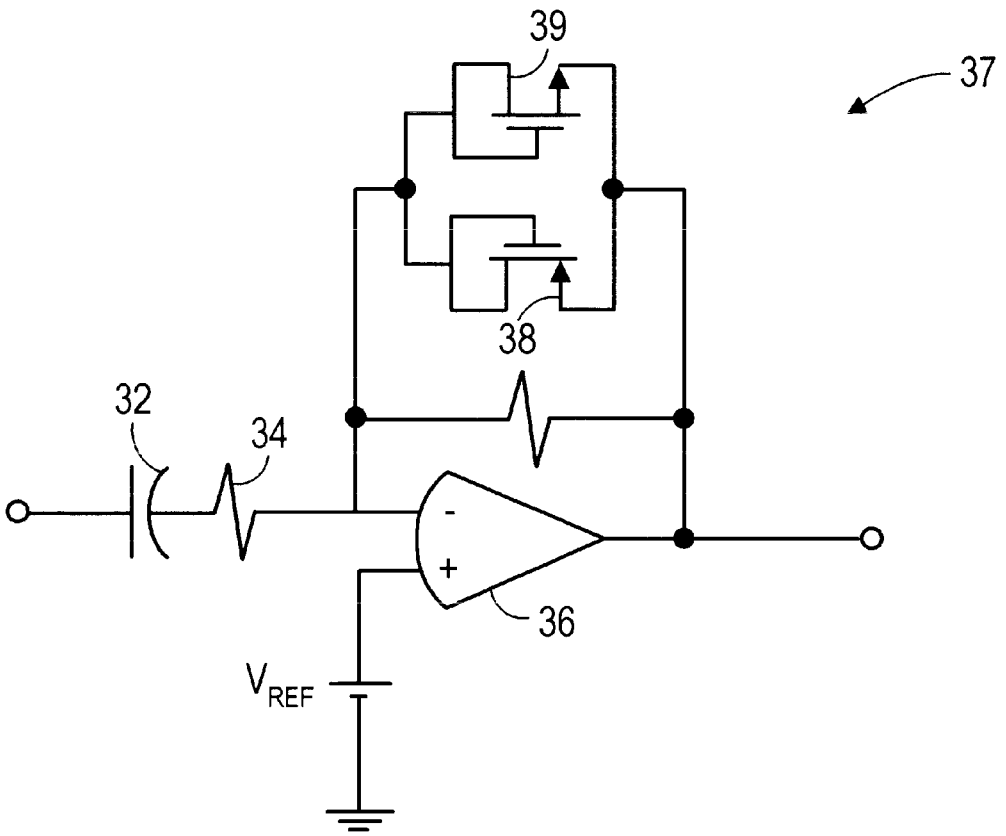
FIG. 2A illustrates an alternative embodiment for one of the first and second limiters.

Alternatively, instead of the two diodes, two metal oxide semiconductor field-effect transistors (MOSFETs) may be used to achieve the same effect by coupling the gate and drain of each MOSFET together. If so, the minimum value of the first and second signals is the reference voltage minus the voltage drop across such MOSFET which is typically between 0.8–1.0 volt depending on whether the MOSFET is a N-channel MOSFET (NMOS) or P-channel MOSFET (PMOS). Likewise, the maximum value of the first and second signals is the reference voltage plus 0.8–1.0 volt. FIG. 2A illustrates a limiter 37 that uses two MOSFETs, a PMOS 38 and a NMOS 39 instead of using two diodes.

Next, the first and second signals are provided to the comparators 50, 60, respectively. In response, the comparators 50, 60 convert the first and second signals to digital signals and thereafter provide such digital signals to a phase detector 72 of the phase-locked loop circuit 70. The phase detector 72 detects a phase difference between the digital signals. Coupled to the phase detector 72 is a low pass filter 72 of the phase-locked loop circuit 70. The low pass filter 74 converts the detected phase difference to a voltage level. In response to such voltage level, a voltage controlled oscillator 76 of the phase-locked loop circuit 70, which is coupled to the low pass filter 74, generates the output signal to drive the speaker 10 via a bipolar junction transistor 82 being shown in place of the switching device 80. Note that there is a resistive element 84 which is coupled to and between the base of the transistor 82 and the voltage controlled oscillator 76.

Alternatively, a metal oxide semiconductor field-effect transistor can also be used as the switching device 80. If so, the resistive element 84 would not be needed because the MOSFET is voltage controlled device unlike the transistor 82 which is current controlled device. Furthermore, if the circuit 100 is driving a piezoelectric device instead of the speaker 10, the output signal from the voltage controlled oscillator 76 can be used to directly drive the piezoelectric device without relying any switching device because a current that is required to drive a piezoelectric device is much smaller than a current that is required to drive the speaker 10.

When the signal at node A is leading the signal at node B, obviously there is a phase difference between such signals so as to indicate that the previous driving frequency of the speaker 10 is less the resonance frequency of the speaker 10. In other words, the existence of the phase difference indicates that the speaker 10 is not being driven at its resonance frequency. In response, the voltage controlled oscillator 76 generates an output signal having a frequency that is higher than frequencies of both the signals at nodes A, B so as to drive the speaker 10 a little faster and thus closer to its resonance frequency. In contrast, when the signal at node A is lagging the signal at node B, this indicates that the previous driving frequency of the speaker 10 is greater than the resonance frequency of the speaker 10. In response, the voltage controlled oscillator 76 generates an output signal having a frequency that is lower than frequencies of both the signals at nodes A, B so as to drive the speaker 10 a little slower and thus closer to its resonance frequency. More specifically, the circuit 100 drives the speaker 10 at its resonance frequency with a response time controlled by transfers functions of the low pass filter 74 and the voltage controlled oscillator 76 when the detected phase difference is negiligible.

Alternatively, the phase difference can also be detected by monitoring the signals at nodes A, C instead of at nodes A, B. Here, the limiter 30 remains coupled to node A but the limiter 40 is coupled node C of FIG. 2, which is between the transistor 82 (or the switching device 80 of FIG. 1) and the resistive element 90. In addition, it should be noted that there are various types of phase-locked loop circuit that can be used for phase difference detection so as to eliminate [1] one of the comparators 50, 60, [2] both of the comparators 50, 60 or [3] the limiters 30, 40 and the comparators 50, 60 from the circuit 100 of the present invention. Furthermore, the present invention may also be implemented as a complementary metal-oxide semiconductor (CMOS) integrated circuit or as a peripheral component of a microprocessor. If so, the speaker 10, the limiters 30, 40, the comparators 50, 60 and the phase-locked loop circuit 70 would be parts of such CMOS integrated circuit or such microprocessor. If the circuit 100 also includes the lock detect circuit 71, such lock detect circuit 71 would also be a part of the CMOS integrated circuit or the microprocessor.

Figure 3:
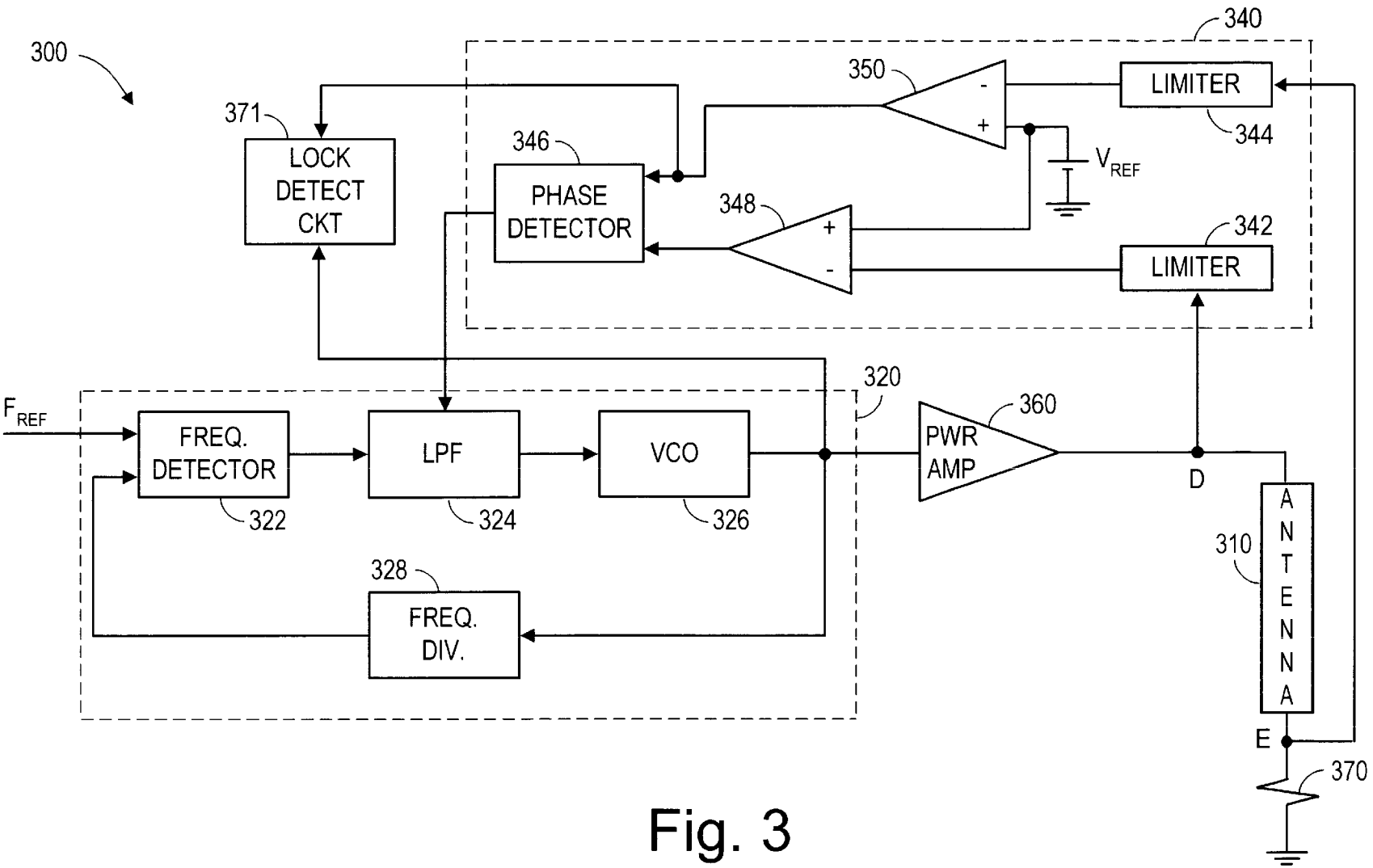
FIG. 3 illustrates a second embodiment of the present invention that is capable of automatically driving a signal transmitting device such as the illustrated antenna at a resonance frequency.

FIG. 3 illustrates a second embodiment of the present invention. This second embodiment includes a circuit 300 that is capable of automatically driving a transmitter such as an antenna 310 at a resonance frequency when a power supply is provided. The circuit 300 comprises [1] a major feedback circuit 320 that preferably includes a frequency detector 322, a lowpass filter 324, a voltage controlled oscillator 326, and a frequency divider 328, [2] a minor feedback circuit 340 that preferably includes limiters 342, 344, a phase detector 346, and comparators 348, 350, [3] a power amplifier 360, and [4] a resistive element 370.

With respect to their electrical connections, the antenna 310 is coupled to the circuit 300 via its connection to and between nodes D, E to which the limiters 342, 344 of the minor feedback circuit 340 are also respectively coupled. In addition, the comparator 348 is coupled between the limiter 342 and the phase detector 346. Similarly, the comparator 350 is coupled between the limiter 344 and the phase detector 346 which in turn is coupled to the lowpass filter 324 of the major feedback circuit 320. The lowpass filter 324 is coupled to and between the frequency detector 322 and the voltage controlled oscillator 326. Likewise, the frequency divider 328 is also coupled to the frequency detector 322 and the voltage controlled oscillator 326 which is in turn coupled to the power amplifier 360. The output terminal of the power amplifier 360 is coupled to node D. And lastly, the resistive element 370 is coupled between node E and a reference ground.

Furthermore, in a preferred embodiment, the circuit 300 also includes a lock detect circuit 371 providing an error signal that indicates whether the antenna 310 is being driven at its resonance frequency by the circuit 300. This error signal may be used to drive a light emitting diode (LED) so as to cause the LED to turn [1] "off" when the antenna 310 is being driven at its resonance frequency and [2] "on" when the antenna 310 is not being driven at its resonance frequency, or vice versa. Thus, if the LED remains "on" for a while, this may indicate that [1] there is a fault associated with the antenna 310 so as to cause an open circuited condition between nodes D, E or [2] the power amplifier 360 is not working properly. If such indication is desirable, the lock detect circuit 371 is preferably coupled to [1] one of the comparators 348, 350 and [2] the voltage controlled oscillator 326 of the major feedback circuit 320 so as to detect a phase difference between [a] an output signal of one of the comparators 348,350 and [b] an output signal of the voltage controlled oscillator 326 being provided to drive the antenna 310. Alternatively, the lock detect circuit 371 may also be coupled to the comparators 348, 350 so as to detect a phase difference between their output signals. When such detected phase difference is negligible, the LED would be "off" and when the detected phase difference is not negligible, the LED would be "on."

When a power supply provides electrical energy to drive the antenna 310, the power amplifier 360 drives the antenna 310 in response to an output signal generated by voltage controlled oscillator 326 of the major feedback circuit 320. The frequency of this output signal will be adjusted, if necessary, based on [1] a frequency difference detected by the frequency detector 322 of the major feedback circuit 320 and [2] a phase difference detected by the phase detector 346 of the minor feedback circuit 340. With respect to the detected frequency difference, the frequency detector 322 detects a frequency difference between [a] a reference signal and [b] a signal from the frequency divider 328 whose frequency is an integral proper fraction of the frequency of the output signal of the voltage controlled oscillator 326. The reference frequency being provided to the frequency detector 322 is preferably between 1 MHZ and 20 MHZ and can be less or more than this specified range depending on the type of frequency divider being used. With respect to the detected phase difference, the minor feedback circuit 340 detects a phase difference between signals at nodes D, E. More specifically, the limiters 342, 344, which are functionally similar to the limiters 30, 40 of FIG. 2, respectively detect the signals at nodes D, E and convert them to first and second signals that have [1] a common zero-crossing reference and [2] minimum and maximum values which are substantially identical. These first and second signals are then provided to the comparators 348, 350, respectively. In response, the comparators 348, 350 convert the first and second signals to digital signals and thereafter provide such digital signals to the phase detector 346 which in turn detects a phase difference between the digital signals. Based on these detected frequency and phase differences, the lowpass filter 324 generates a voltage level. In response to such voltage level, the voltage controlled oscillator 326 generates an output signal for the power amplifier 360 to drive the antenna 310.

When the signal at node D is leading the signal at node E, obviously there is a phase difference between such signals so as to indicate that the previous driving frequency of the antenna 310 is less the resonance frequency of the antenna 310. In other words, the existence of the phase difference indicates that the antenna 310 is not being driven at its resonance frequency. In response, the voltage controlled oscillator 326 generates an output signal having a frequency that is higher than frequencies of both the signals at nodes D, E so as to drive the antenna 310 a little faster and thus closer to its resonance frequency. In contrast, when the signal at node D is lagging the signal at node E, this indicates that the previous driving frequency of the antenna 310 is greater than the resonance frequency of the antenna 310. In response, the voltage controlled oscillator 326 generates an output signal having a frequency that is lower than frequencies of both the signals at nodes D, E so as to drive the antenna 310 a little slower and thus closer to its resonance frequency. More specifically, the circuit 300 drives the antenna 310 at its resonance frequency with a response time controlled by transfers functions of the low pass filter 324 and the voltage controlled oscillator 326 when the detected phase difference is negiligible.

It should be noted that the signals at nodes D, E being detected to determine their phase difference are voltage signals at such nodes. Alternatively, voltage and current signals at nodes D, E, respectively, may also be detected to determine their phase difference. This phase difference is also equivalent to the phase difference between the detected voltage signals due to Ohm's Law. More specifically, $V_D=V_E-IZ$, where $V_D$ is the voltage at node D, $V_E$ is the voltage at node E, I is the current flowing from node D to node E, and Z is the complex impedance of the speaker 310.

Moreover, it should also be noted that the lowpass filter 324 relies mainly on the detected frequency difference to generate the voltage level. The minor feedback circuit 340 has limited frequency adjustment capability because it is being implemented to account for the effect of parasitic capacitance associated with the printed circuit board upon which the antenna 310 is attached to. The presence of such parasitic capacitance effectively changes the resonance driving frequency of the antenna 310 and thus the phase difference detected by the minor feedback circuit 340 allows the lowpass filter 324 to account for the minor effect of such parasitic capacitance.

Figure 4:
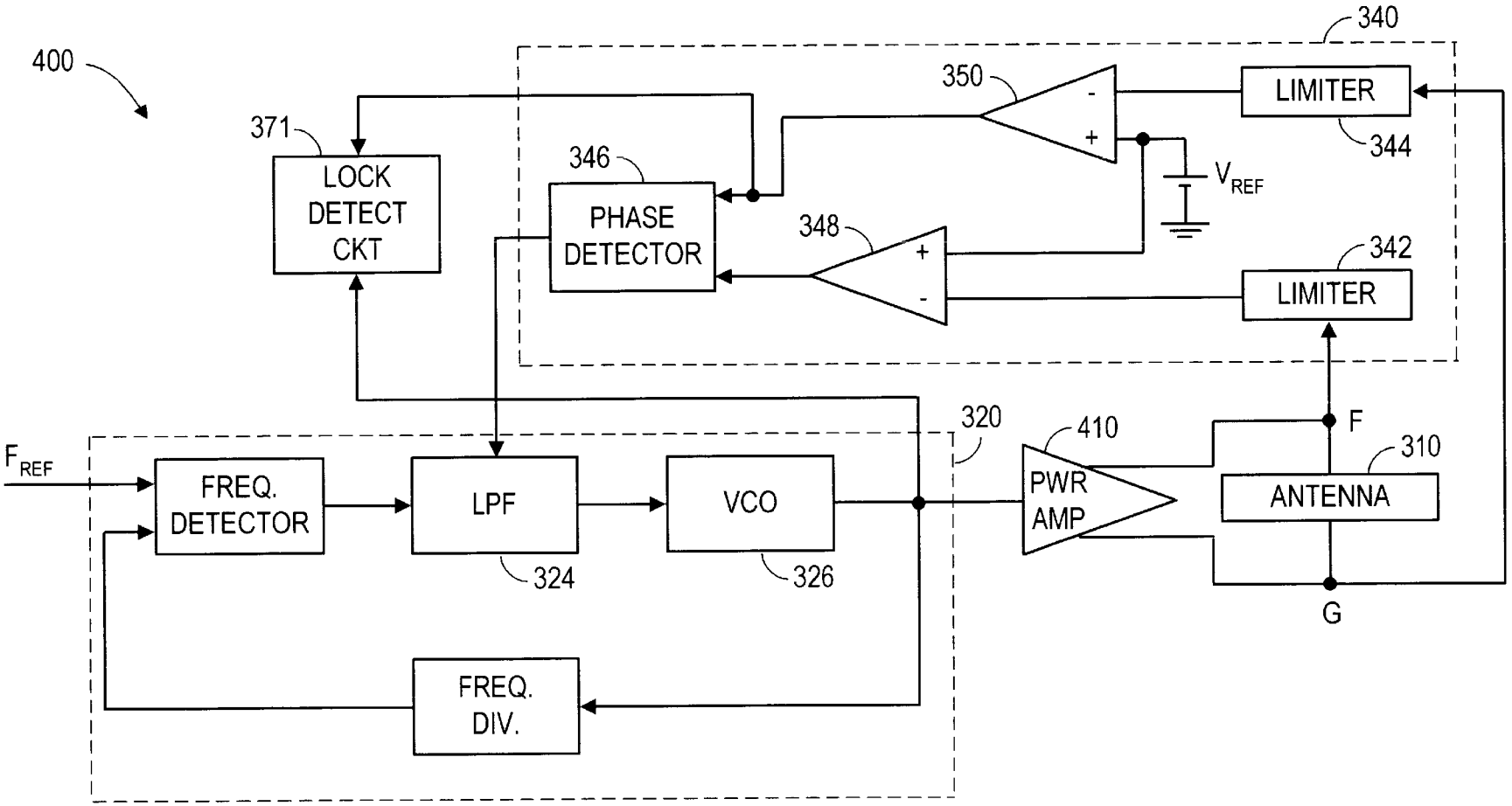
FIG. 4 illustrates a third embodiment of the present invention that is also capable of automatically driving a signal transmitting device such as the illustrated antenna at a resonance frequency.

FIG. 4 illustrates a third embodiment of the present invention. This third embodiment includes a circuit 400 that is also capable of automatically driving a transmitter such as the antenna 310 at a resonance frequency when a power supply is provided. The circuit 400 is substantially similar the circuit 300 of FIG. 3. The only difference is that the circuit 400 includes a power amplifier 400 having two output terminals F, G between and to which the antenna 310 is coupled. Therefore, the minor feedback circuit 340 is coupled to nodes F, G so as to detect a phase difference between signals at such nodes. Otherwise, the operation of the circuit 400 is similar to the operation of the circuit 300. In addition, it should be noted that both the circuits 300, 400 can still operate without including [1] one of the comparators 348, 350, [2] both of the comparators 348, 350 or [3] the limiters 342, 344 and the comparators 348, 350, depending on the type of phase detector being used. Furthermore, the present invention in accordance with FIGS. 3 and 4 may also be implemented as a CMOS integrated circuit or as a peripheral component of a microprocessor. If so, both the major and minor feedback circuits 320 and 340, respectively, would be parts of such CMOS integrated circuit or such microprocessor. If the circuit 300 also includes the lock detect circuit 371, such lock detect circuit 371 would also be a part of the CMOS integrated circuit or the microprocessor.

In summary, the present invention automatically drives a mechanical device such as a speaker or an antenna at a resonance frequency when a power supply is provided. By doing so, there are several advantages associated with the present invention. First, manufacturers of alarm systems, wireless RF key fobs, remote control garage door openers, and similar devices can now eliminate the laborious and expensive "tweeking" step from the production process. Second, the life of a battery providing electrical energy to run an alarm system or a wireless RF key fob can now be maximized. Third, wireless RF key fobs or alarm systems can now generate the greatest amount of or the loudest audible signals by using optimal electrical energy, respectively. And fourth, an indication is provided if the device is not being driven at its resonance frequency.

With the present invention has been described in conjunction with several alternative embodiments, these embodiments are offered by way of illustration rather than by way of limitation. Those skilled in the art will be enabled by this disclosure to make various modifications and alterations to the embodiments described without departing from the spirit and scope of the present invention. Accordingly, these modifications and alterations are deemed to lie within the spirit and scope of the present invention as specified by the appended claims.

I claim:

1. An acoustic transducer system comprising:

a power supply;

an acoustic transducer having a first electrical terminal coupled to the power supply and a second electrical terminal coupled to a reference ground; and a phase-locked loop circuit detecting a phase difference between first and second signals at the first and second electrical terminals, respectively, and generating an output signal based on the detected phase difference to drive the acoustic transducer via a feedback connection forming a closed loop from the phase-locked loop circuit back to the second electrical terminal, wherein the output signal drives the acoustic transducer at its resonance frequency when the detected phase difference is negligible.

2. The acoustic transducer system of claim 1 further comprises:

a first zero-crossing limiter, coupled to and between the first electrical terminal and the phase-locked loop circuit, converting the first signal to a third signal; and a second zero-crossing limiter, coupled to and between the second electrical terminal and the phase-locked loop circuit, converting the second signal to a fourth signal, wherein the third and fourth signals have a common zero-crossing reference, and further wherein the phase-locked loop circuit detects a phase difference between the third and fourth signals.

3. The acoustic transducer system of claim 2 further comprises:

a first comparator, coupled to and between the first zero-crossing limiter and the phase-locked loop circuit, converting the third signal to a first digital signal; and a second comparator, coupled to and between the second zero-crossing limiter and the phase-locked loop circuit, converting the fourth signal to a second digital signal, wherein the phase-locked loop circuit detects a phase difference between the first and second digital signals.

4. The acoustic transducer system of claim 2 further comprises a comparator, coupled to and between the second zero-crossing limiter and the phase-locked loop circuit, converting the fourth signal to a digital signal, wherein phase-locked loop circuit detects a phase difference between the third signal and the digital signal.

5. The acoustic transducer system of claim 2, wherein each of the first and second zero-crossing limiter comprises:

an amplifier having an inverting terminal, a non-inverting terminal and an output terminal, said non-inverting terminal coupled to a reference voltage and said output terminal coupled to the phase-locked loop circuit;

a capacitive element coupled to one of the first or second electrical terminal of the acoustic transducer;

a first resistive element coupled to the capacitive element and the inverting terminal;

a second resistive element coupled to the inverting terminal and the output terminal;

a first diode having an anode that is coupled to the output terminal and a cathode that is coupled to the inverting terminal; and a second diode having an anode that is coupled to the inverting terminal and a cathode that is coupled to the output terminal.

6. The acoustic transducer system of claim 5, wherein maximum values of the third and fourth signals are substantially identical, and further wherein minimum values of the third and fourth signals are substantially identical.

7. The acoustic transducer system of claim 1, wherein the phase-locked loop circuit comprises:

a phase detector detecting the phase difference;

a low pass filter converting the detected phase difference to a voltage level; and a voltage controlled oscillator generating the output signal in response to the voltage level from the lowpass filter.

8. The acoustic transducer system of claim 1, wherein the output signal has a frequency that is higher than frequencies of the first and second signals when the first signal leads the second signal, and further wherein the output signal has a frequency that is lower than frequencies of the first and second signals when the first signal lags the second signal.

9. The acoustic transducer system of claim 1, wherein the acoustic transducer is a piezoelectric transducer.

10. The acoustic transducer system of claim 1 further comprises a switching device driving the acoustic transducer in response to the output signal, wherein the switching device is coupled to and between the second electrical terminal and the reference ground, and further wherein the acoustic transducer is an electro-mechanical transducer or a loudspeaker.

11. The acoustic transducer system of claim 10, wherein the switching device is a metal-oxide semiconductor field-effect transistor.

12. The acoustic transducer system of claim 10 further comprises a resistive element coupled to and between the phase-locked loop circuit and the switching device, wherein the switching device is a bipolar junction transistor.

13. The acoustic transducer system of claim 10 further comprises a resistive element coupled to and between the switching device and the reference round.

14. The acoustic transducer system of claim 1 further comprises a lock detect circuit detecting a phase difference between either the first or second signal and the output signal of the phase locked loop circuit and providing an indication that the acoustic transducer is being driven at its resonance frequency when the detected phase difference is negligible.

15. The acoustic transducer system of claim 5, wherein the amplifier is an operational amplifier.

16. A circuit automatically driving an acoustic transducer coupled to the circuit at a resonance frequency when a power supply is provided to drive the acoustic transducer, comprising:

a phase detector continuously detecting a phase difference between first and second signals at first and second electrical terminals of the acoustic transducer, respectively;

a lowpass filter converting the detected phase difference to a voltage level; and a voltage controlled oscillator generating an output signal in response to the voltage level from the lowpass filter, said output signal driving the acoustic transducer at a resonance frequency when the detected phase difference is negligible, wherein the output signal drives the acoustic transducer via a feedback connection forming a closed loop from the voltage controlled oscillator back to the second electrical terminal, and further wherein the first electrical terminal is coupled to the power supply and the second electrical terminal is coupled to a reference ground.

17. A circuit automatically driving an acoustic transducer coupled to the circuit at a resonance frequency when a power supply is provided to drive the acoustic transducer, comprising:

a phase detector continuously detecting a phase difference between first and second signals at first and second electrical terminals of the acoustic transducer, respectively;

a lowpass filter converting the detected phase difference to a voltage level;

a voltage controlled oscillator generating an output signal in response to the voltage level from the lowpass filter, said output signal driving the acoustic transducer at a resonance frequency when the detected phase difference is negligible;

a first zero-crossing limiter, coupled to and between the first electrical terminal and the phase detector, converting the first signal to a third signal; and a second zero-crossing limiter, coupled to and between the second electrical terminal and the phase detector, converting the second signal to a fourth signal, wherein the third and fourth signals have a common zero-crossing reference, and further wherein the phase detector detects a phase difference between the third and fourth signals.

18. The circuit of claim 17 further comprises:

a first comparator, coupled to and between the first zero-crossing limiter and the phase detector, converting the third signal to a first digital signal; and a second comparator, coupled to and between the second zero-crossing limiter and the phase detector, converting the fourth signal to a second digital signal, wherein the phase detector detects a phase difference between the first and second digital signals.

19. The circuit of claim 17 further comprises a comparator, coupled to and between the second zero-crossing limiter and the phase detector, converting the fourth signal to a digital signal, wherein the phase detector detects a phase difference between the third signal and the digital signal.

20. The circuit of claim 17, wherein each of the first and second zero-crossing limiter comprises:

an amplifier having an inverting terminal, a non-inverting terminal and an output terminal, said non-inverting terminal coupled to a reference voltage and output terminal coupled to the phase detector;

a capacitive element coupled to one of the first or second electrical terminal of the acoustic transducer;

a first resistive element coupled to the capacitive element and the inverting terminal;

a second resistive element coupled to the inverting terminal and the output terminal;

a first diode having an anode that is coupled to the output terminal and a cathode that is coupled to inverting terminal; and a second diode having an anode that is coupled to the inverting terminal and a cathode that is coupled to the output terminal.

21. The circuit of claim 20, wherein maximum values of the third and fourth signals are substantially identical, and further wherein minimum values of the third and fourth signals are substantially identical.

22. A circuit automatically driving an acoustic transducer coupled to the circuit at a resonance frequency when a power supply is provided to drive the acoustic transducer, comprising:

a phase detector continuously detecting a phase difference between first and second signals at first and second electrical terminals of the acoustic transducer, respectively;

a lowpass filter converting the detected phase difference to a voltage level; and a voltage controlled oscillator generating an output signal in response to the voltage level from the lowpass filter, said output signal driving the acoustic transducer at a resonance frequency when the detected phase difference is negligible, wherein the output signal has a frequency that is higher than frequencies of the first and second signals when the first signal leads the second signal, and further wherein the output signal has a frequency that is higher than frequencies of the first and second signals when the first signal lags the second signal.

23. The circuit of claim 16, wherein the acoustic transducer is a piezoelectric transducer.

24. The circuit of claim 16 further comprises a switching device driving the acoustic transducer in response to the output signal, wherein the switching device is coupled to and between the second electrical terminal and the reference ground, and further wherein the acoustic transducer is an electro-mechanical transducer or a loudspeaker.

25. The circuit of claim 24, wherein the switching device is a metal-oxide semiconductor field-effect transistor.

26. The circuit of claim 24 further comprises a resistive element coupled to and between the phase-locked loop circuit and the switching device, wherein the switching device is a bipolar junction transistor.

27. The circuit of claim 24 further comprises a resistive element coupled to and between the switching device and the reference ground.

28. A circuit automatically driving an acoustic transducer coupled to the circuit at a resonance frequency when a power supply is provided to drive the acoustic transducer, comprising:

a phase detector continuously detecting a phase difference between first and second signals at first and second electrical terminals of the acoustic transducer, respectively;

a lowpass filter converting the detected phase difference to a voltage level;

a voltage controlled oscillator generating an output signal in response to the voltage level from the lowpass filter, said output signal driving the acoustic transducer at a resonance frequency when the detected phase difference is negligible; and a lock detect circuit detecting a phase difference between either the first or second signal and the output signal of the voltage controller oscillator and providing an indication that the acoustic transducer is being driven at its resonance frequency when the detected phase difference is negligible.

29. The circuit of claim 20, wherein the amplifier is an operational amplifier.

* * * * *